US010378805B2

(12) United States Patent
Jin et al.

(10) Patent No.: US 10,378,805 B2
(45) Date of Patent: Aug. 13, 2019

(54) MODEL PREDICTIVE CONTROL FOR HEAT TRANSFER TO FLUIDS

(71) Applicant: Alliance for Sustainable Energy, LLC, Golden, CO (US)

(72) Inventors: Xin Jin, Lakewood, CO (US); Jeff Maguire, Boulder, CO (US); Dane Christensen, Lakewood, CO (US)

(73) Assignee: Alliance for Sustainable Energy, LLC, Golden, CO (US)

( * ) Notice: Subject to any disclaimer, the term of this patent is extended or adjusted under 35 U.S.C. 154(b) by 1149 days.

(21) Appl. No.: 14/642,581

(22) Filed: Mar. 9, 2015

(65) Prior Publication Data

US 2015/0253051 A1 Sep. 10, 2015

Related U.S. Application Data

(60) Provisional application No. 61/949,604, filed on Mar. 7, 2014.

(51) Int. Cl.
*F25B 49/02* (2006.01)
*F25B 30/02* (2006.01)

(52) U.S. Cl.
CPC ..... *F25B 49/02* (2013.01); *F25B 2500/19* (2013.01)

(58) Field of Classification Search
CPC .. F24D 19/10; F24D 19/1063; F24D 19/1081; F24D 19/1096; F25B 2500/19; F24H 4/02; F24H 4/04; F24H 9/2014; F24F 2221/183; G05B 13/041; G05B 13/042; G05B 13/047; G05B 13/048; G05D 7/0623; G05D 7/0617
See application file for complete search history.

(56) References Cited

U.S. PATENT DOCUMENTS 5,056,712 A 10/1991 Enck
8,165,726 B2 * 4/2012 Nordberg ..... G05D 23/1917 122/13.01
2004/0267395 A1 * 12/2004 Discenzo ..... G05B 13/024 700/99
2013/0051777 A1 * 2/2013 Brian ..... F24H 1/20 392/464
2013/0282181 A1 10/2013 Lu et al.
2014/0321839 A1 * 10/2014 Armstrong ..... F24H 9/2021 392/463

FOREIGN PATENT DOCUMENTS

WO 2012162763 A1 12/2012

OTHER PUBLICATIONS

Jin, X., "Model Predictive Control of Heat Pump Water Heaters for Energy Efficiency", 2014 ACEEE Summer Study of Energy Efficiency in Buildings, Aug. 17-22, 2014, Pacific Grove, California, pp. 1-133-1-145.

(Continued)

*Primary Examiner* — Jianying C Atkisson
*Assistant Examiner* — Meraj A Shaikh
(74) *Attorney, Agent, or Firm* — Alexandra M. Hall; Michael A. McIntyre

(57) ABSTRACT

Model predictive control methods are disclosed which provide, among other things, efficient strategies for controlling heat-transfer to a fluid.

13 Claims, 12 Drawing Sheets

(56) References Cited

OTHER PUBLICATIONS

Bohac, D., et al., "Actual Savings and Performance of Natural Gas Tankless Water Heaters," Technical Report, Minneapolis, Minnesota: Center for Energy and Environment, Aug. 30, 2010.
Henze G.P., et al., "Development of a Model Predictive Controller for Tankless Water Heaters," HVAC&R Research, vol. 15, No. 1, Jan. 2009, pp. 3-23.
Hirst, E., et al., "Residential Water Heaters: Energy and Cost Analysis," Energy and Buildings, vol. 1, 1977/1978, pp. 393-400.
Sparn, B., et al., "Laboratory Performance Evaluation of Residential Integrated Heat Pump Water Heaters," 2011 Technical Report, NREL/TP-5500-52635, Golden, Colorado: National Renewable Energy Laboratory.
Sparn, B., et al., "Laboratory Performance Evaluation of Residential Integrated Heat Pump Water Heaters," 2011 Technical Report, NREL/TP-5500-52635, revised Jun. 14, 2014, Golden, Colorado: National Renewable Energy Laboratory.

* cited by examiner

MODEL PREDICTIVE CONTROL FOR HEAT TRANSFER TO FLUIDS

CONTRACTUAL ORIGIN

The United States Government has rights in this invention under Contract No. DE-AC36-08GO28308 between the United States Department of Energy and the Alliance for Sustainable Energy, LLC, the Manager and Operator of the National Renewable Energy Laboratory.

BACKGROUND

According to the U.S. Environmental Protection Agency, buildings accounted for about 38.9% of the total U.S. energy consumption in 2005. Residential buildings accounted for 53.7% of the total, while commercial buildings accounted for the remaining 46.3%. In addition, buildings accounted for 72% of the total U.S. electricity consumption in 2006. 51% of this total was attributed to residential building use, with the remaining 49% to commercial buildings. While energy consumption in the U.S. manufacturing sector has declined from about 22,576 trillion BTU in 2002 to about 18,817 trillion BTU in 2010, the U.S. is still the largest global consumer of energy.

Despite efforts within the residential housing industry to introduce more energy efficient technologies such as more efficient equipment, better insulation, and more efficient windows, according to the U.S. Energy Information Administration, the total energy consumption per household in the United States continues to rise, largely due to increases in electricity demand. For example, in 1993 the total consumption of energy in homes by end-users totaled about 10.01 quadrillion BTU, with about 18.3% of that utilized for water heating, and about 4.6% for air conditioning. In 2009 residential end users consumed about 10.18 quadrillion BTU, with about 17.7% of that utilized for water heating, and about 6.2% for air conditioning.

Thus, there continues to be a significant need for methods and systems that reduce energy usage and/or provide more energy efficient systems, in residential housing, commercial buildings, and industry.

SUMMARY OF INVENTION

An aspect of the present invention is a method for controlling a temperature of a fluid, where the method includes defining an objective function as a function of at least a future fluid temperature set-point for a heating element configured to heat the fluid, initializing an intermediate fluid temperature set-point, changing the intermediate fluid temperature set-point. The objective function is solved with the changed intermediate fluid temperature set-point, and the objective function is optimized by repeating the changing and the solving. The method then sets the future fluid temperature set-point for the heating element equal to the intermediate fluid temperature set-point corresponding to the optimized objective function.

In some embodiments of the present invention, the objective function may be a function of a future fluid usage prediction, and the future fluid usage prediction may be at least partially determined by historical fluid usage data. The historical fluid usage data may be determined by defining a first time period (T), defining a second time period (t) by dividing T by an integer value (N) such that T is divided into N equal and consecutive time intervals ($t_n$), and T restarts and repeats upon completion of the last $t_n$, and collecting consecutive measurements of actual fluid usage data ($F_n$) for each consecutive $t_n$ as the historical usage data.

In some embodiments of the present invention, the method for controlling a temperature of a fluid may include storing on a data storage medium no more than N sets of consecutive measurements. In some embodiments of the present invention, the historical fluid usage data may include a measurement of at least one of a fluid flow or a fluid temperature.

In some embodiments of the present invention, the objective function may also be a function of an input energy required to heat the fluid for the future usage prediction to the future fluid temperature set-point, and the objective function may be optimized to minimize the input energy required.

In some embodiments of the present invention, the input energy required may be calculated using a mass and energy balance, by defining a fluid volume including at least two fluid containing nodes in series, where each node may be characterized by a fluid temperature, a first node may have a maximum fluid temperature, and each subsequent adjacent node in the series may have a fluid temperature less than or equal to the fluid temperature of the node immediately preceding and adjacent to it. The mass and energy balance may then calculate for each node the energy required to heat the fluid of that node to the future fluid temperature set-point, and sum the energy calculated for each node to yield the input energy required.

In some embodiments of the present invention, the energy required to heat the fluid of each node may be adjusted by at least one of an energy loss from the node to a local surrounding, an energy loss from the node to an adjacent node, an energy input into the node from mixing, or an energy input into the node by conduction from an adjacent node. In some embodiments of the present invention, the input energy may be calculated using a state space model.

In some embodiments of the present invention, the heating element may include at least one of a resistive heating element or a heat pump. In some embodiments, the fluid may be a liquid. In some embodiments, the liquid may be water. In some embodiments, the future temperature set-point may range from about 0° F. to about 500° F.

An aspect of the present invention is a method for controlling a temperature of water, where the method includes defining an objective function as a function of at least one future water temperature set-point for a resistive heating element and a heat pump, where both the resistive heating element and the heat pump are configured to heat the water. The method includes initializing an intermediate water temperature set-point, changing the intermediate water temperature set-point, solving the objective function with the changed intermediate water temperature set-point, optimizing the objective function by repeating the changing and the solving, and setting the future water temperature set-point equal to the intermediate water temperature set-point corresponding to the optimized objective function.

In some embodiments of the present invention, the objective function may also include a function of a future water volume usage prediction, and the future water volume usage prediction may be at least partially determined by historical water volume usage data.

In some embodiments of the present invention, the historical water usage data may be determined by defining a first time period, defining a second time period by dividing the first time period by an integer (N), defining a third time period by dividing the second time period by an integer (I) to create N*I consecutive time intervals, where each time interval is about equal to the third time period, and collecting consecutive measurements of actual water flow and water temperature data for each consecutive time interval as the historical usage data. In some embodiments of the present invention, the first time period may equal about 14 days, the second time period may equal about 1 day for an N of about 10, and the third time period may be about 30 minutes for an 1 of about 48.

In some embodiments of the present invention, the objective function may be a function of a calculated input energy required to heat the water for the future water usage prediction to the future fluid temperature set-point, and the objective function may be optimized to minimize the input energy required, by utilizing the energy input calculation that includes defining a fluid volume comprising a first water containing node and a second water containing node in series, where both nodes are characterized by a first and second water temperature respectively, the first water temperature is a highest temperature, and the second water temperature is less than or equal to the first water temperature. The energy input calculation may then calculate calculating for both nodes the energy required to heat the water to the future water temperature set-point, and sum the energy calculated for both nodes to yield the input energy required.

DRAWINGS

Exemplary embodiments are illustrated in referenced figures of the drawings. It is intended that the embodiments and figures disclosed herein are to be considered illustrative rather than limiting.

Figure 8:
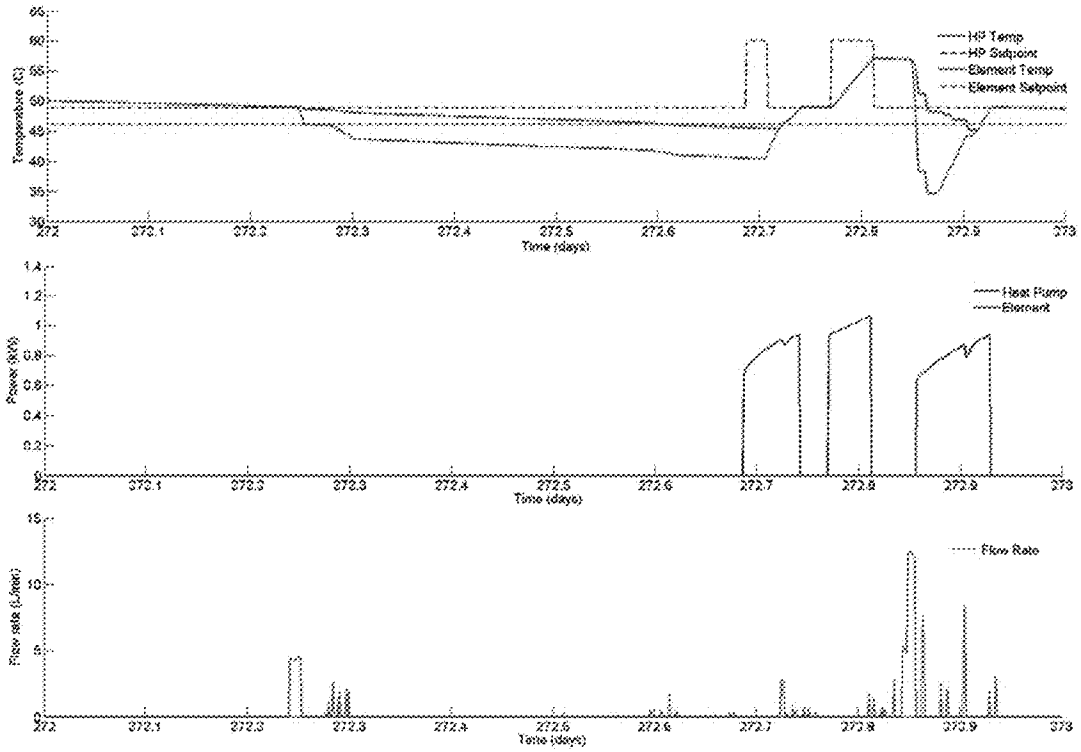

FIG. 8 summarizes experimental results from embodiment of the present invention.

Figure 9:
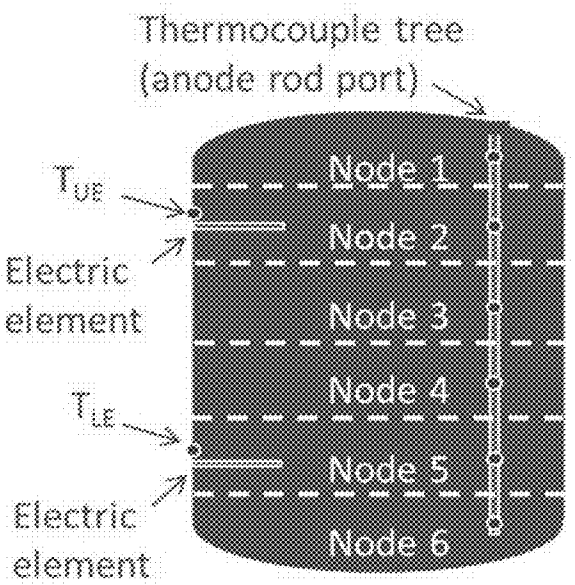

FIG. 9 illustrates an actual 6 node HPWH that was utilized to generate experimental data evaluating some embodiments of the present invention.

Figure 10:
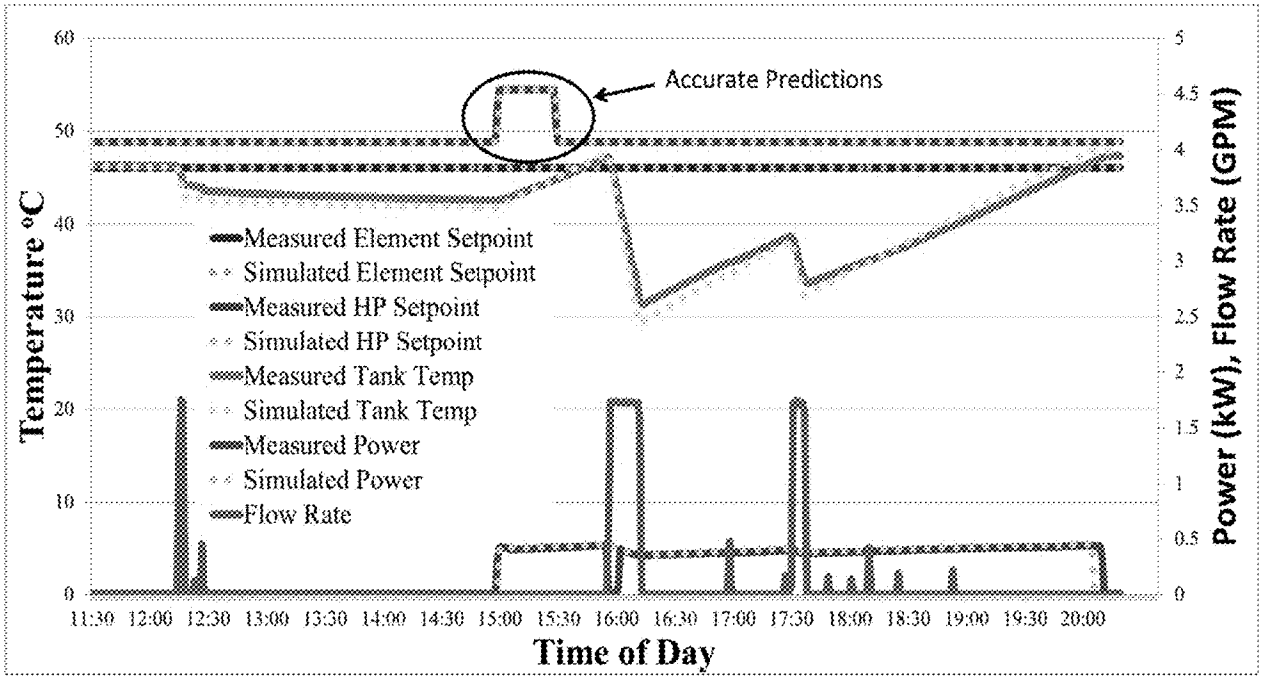

FIG. 10 compares experimental and simulation data obtained using MPC strategies as described herein for the control of HPWHs.

Figure 11:
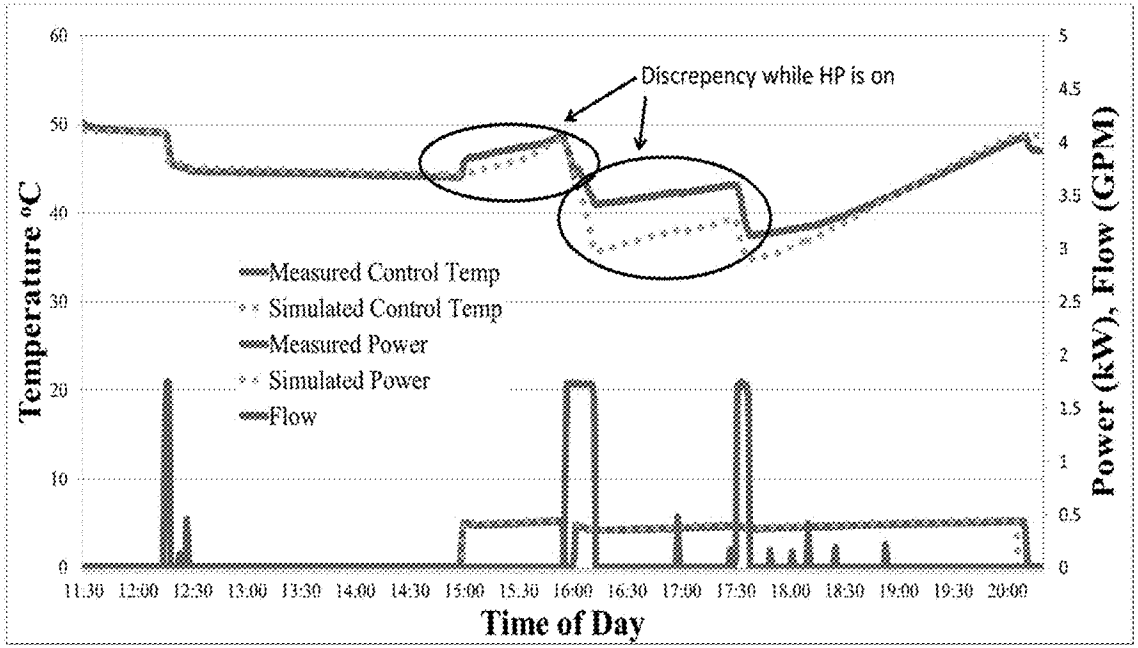

FIG. 11 compares experimental and simulation data obtained using MPC strategies as described herein for the control of HPWHs.

Figure 12:
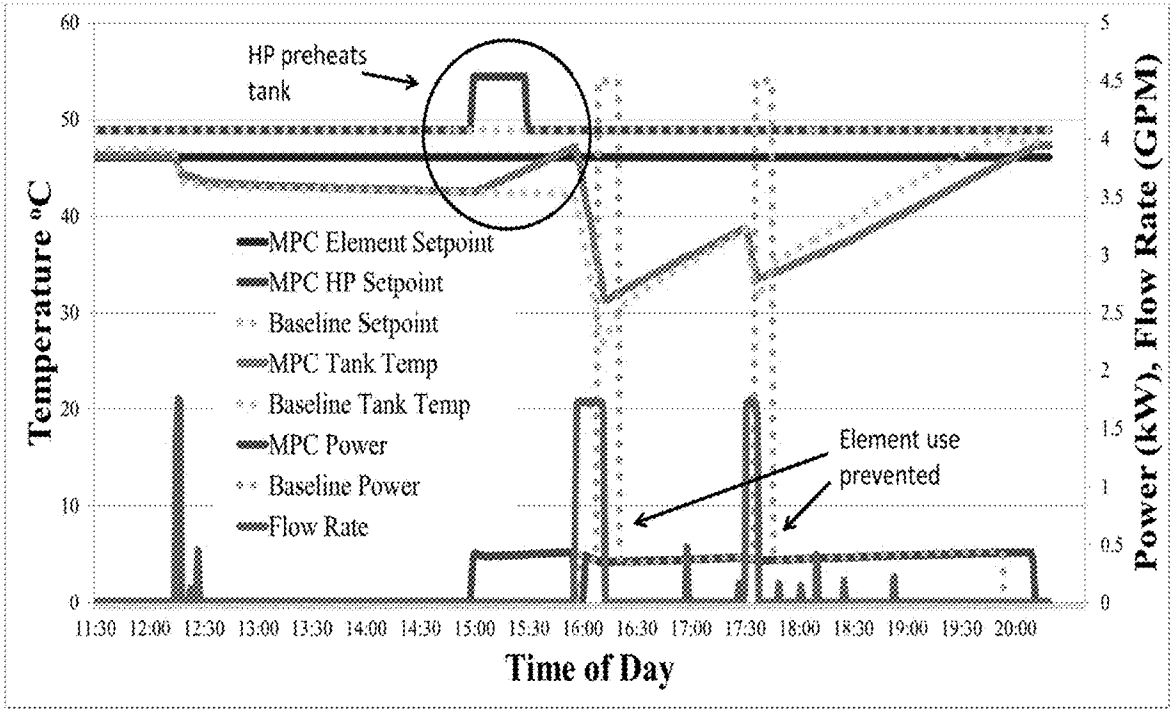

FIG. 12 compares experimental data obtained using MPC strategies as described herein for the control of HPWHs versus a control strategy for a HPWH that used a fixed set-point control strategy.

REFERENCE NUMBERS

100 . . . heat transfer system
110 . . . model predictive controller
120 . . . heat transfer device
130 . . . heat transfer element
140 . . . sensor/transmitter
150 . . . signal
160 . . . control variable set-point
170 . . . actuator
180 . . . fluid supply stream
190 . . . fluid outlet stream
200 . . . model predictive controller
210 . . . resource prediction module
220 . . . energy calculation module
230 . . . control variable set-point optimizer module
240 . . . signal
250 . . . resource prediction
260 . . . energy estimate
265 . . . set-point estimate
270 . . . control variable set-point

DETAILED DESCRIPTION OF EMBODIMENTS

Figure 1:
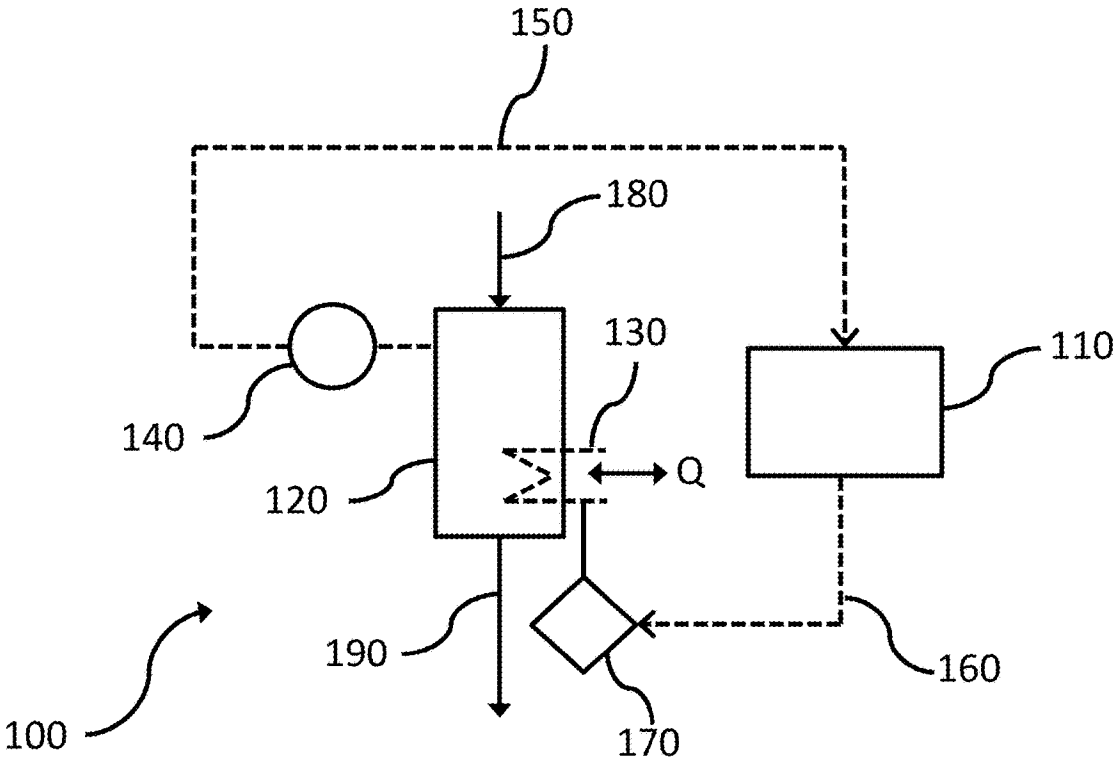
FIG. 1 illustrates an embodiment of the present invention, a heat transfer system where the heat transferred to the system is controlled by a model predictive controller.

FIG. 1 illustrates one embodiment of the present invention, a heat transfer system 100 where energy supplied and/or removed (Q) to and/or from a heat transfer device 120 may be via a heat transfer element 130, which may be controlled by a model predictive controller 110. The energy (Q) may be either removed or supplied to the heat transfer system 100 as indicated by the line with an arrow pointing in both directions.

The heat transfer system 100 may include at least one fluid supply stream 180 to the heat transfer device 120 and at least one fluid outlet stream 190. A fluid supply stream 180 may provide a fluid that is a liquid and/or a gas. For example, a fluid supply stream 180 may provide water, an aqueous liquid, an organic liquid, an inorganic liquid, and/or any other liquid used in commercial, residential, and/or industrial applications. A fluid supply stream 180 may provide a gas, such as air, oxygen, nitrogen, and/or any other gas used in commercial, residential, and/or industrial environments. After energy is transferred to the fluid entering the heat transfer device 120, the heated/cooled fluid may exit as a fluid outlet stream 190. The fluid outlet stream 190 may be either hotter or colder than the fluid supply stream 180. In some embodiments of the present invention, a fluid supply stream 180 entering a heat transfer system 100 may enter at a temperature ranging from about 0° F. to about 500° F. In other cases, a fluid supply stream 180 entering a heat transfer system 100 may enter at a temperature ranging from about 40° F. to about 200° F. In still other cases, a fluid supply stream 180 entering a heat transfer system 100 may enter at a temperature ranging from about 30° F. to about 100° F. In some embodiments of the present invention, a fluid outlet stream 190 leaving a heat transfer system 100 may exit at a temperature ranging from about 0° F. to about 500° F. In other cases, a fluid outlet stream 190 leaving a heat transfer system 100 may exit at a temperature ranging from about 30° F. to about 200° F. In still other cases, a fluid outlet stream 190 leaving a heat transfer system 100 may exit at a temperature ranging from about 100° F. to about 180° F. The temperatures of a fluid supply stream 180 and the fluid outlet stream 190 may also be described by the temperature difference between the two streams. For a heating example, where the fluid outlet stream 190 is hotter than the fluid supply stream 180, the fluid outlet stream 190 may range from about 1° F. to about 150° F. hotter than the fluid supply stream 180. In some other examples, the fluid outlet stream 190 may range from about 10° F. to about 100° F. hotter than the fluid supply stream 180. For a cooling example, where the fluid outlet stream 190 is colder than the fluid supply stream 180, the fluid outlet stream 190 may range from about 1° F. to about 100° F. colder than the fluid supply stream 180. In some other examples, the fluid outlet stream 190 may range from about 10° F. to about 50° F. colder than the fluid supply stream 180.

The model predictive controller 110 may receive at least one signal 150 representing one or more measurements taken of the heat transfer system 100 by at least one sensor/transmitter 140. For example, a sensor/transmitter 140 may include a temperature sensor/transmitter, such as a thermometer, a thermocouple, an infrared (IR) sensor, and/or a resistance temperature detector (RTD) that measures a temperature of the system. A measured temperature of the heat transfer system 100 may be any fluid temperature, such as a fluid entering the system, leaving the system, or within the system. Alternatively or in addition, a measured temperature may include a surface temperature. Alternatively or in addition to, a sensor/transmitter 140 may measure at least one of a mass, a volume, a density, a mass flow-rate, a volumetric flow-rate, or a combination thereof. For example, a volumetric flow rate may be measured for a fluid supply stream 180 entering the heat transfer system 100 and/or a volumetric flow rate may be measured for a fluid outlet stream 190 leaving the heat transfer system. The model predictive controller 110 may then utilize one or more of these measurements of system variables (e.g. temperature, flow, pressure, etc.) to determine an actual amount of a resource (e.g. fluid and/or energy) being utilized by the heat transfer system 100, and/or enable predictions to be made of future resource requirements.

A sensor/transmitter 140 may convert a measurement to a signal 150, which it may then transmit to the model predictive controller 110. For example, the signal 150 may be in the form of a current signal and/or a voltage signal.

In some embodiments of the present invention, the model predictive controller 110 may receive a signal 150 representing a measurement of a heat transfer system 100, for example, at least one fluid temperature and/or volumetric flow measurement. The model predictive controller 110 may utilize the signal 150 to calculate a control variable set-point 160. The model predictive controller may send the control variable set-point 160 to an actuator 170, which may control the energy (e.g. heat) transferred to and/or removed from the heat transfer system by actuating a heat transfer element 130. The control variable set-point 160, like the transmitter signal 150, may be converted to a current signal and/or voltage signal to communicate the control variable set-point 160 to the actuator 170. The actuator 170 may include an on/off electrical switch, a valve, and/or any other suitable device for controlling the energy entered and/or removed from a heat transfer element 130. Examples of heat transfer elements covered within the scope of this invention include resistive heating elements, heat pumps, electromagnetic sources (e.g. for radiant heat transfer), thermoelectric elements, hot and/or cold fluids, and/or any other suitable heat transfer elements that may include radiant, conductive, and/or convective heat transfer.

Figure 2:
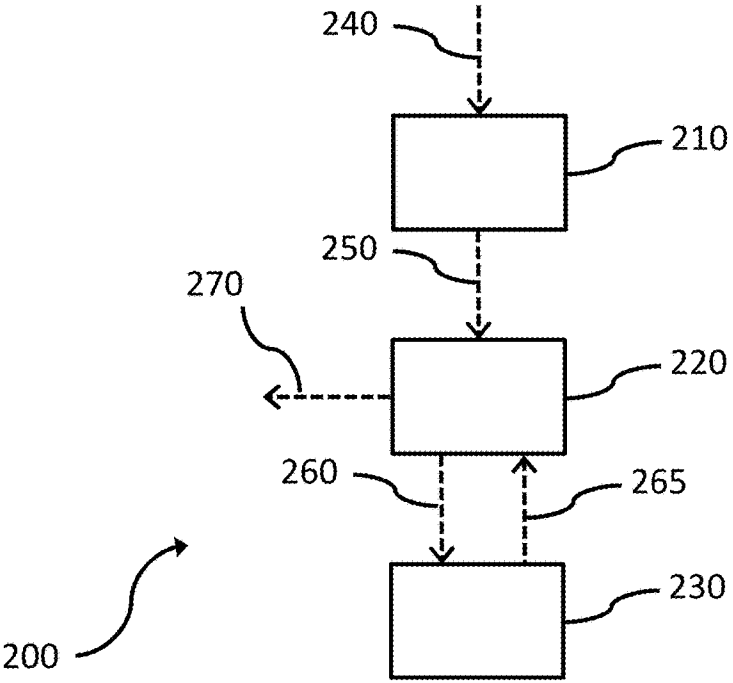
FIG. 2 shows an embodiment of a model predictive controller.

FIG. 2 illustrates some of the embodiments of the model predictive controller 200 in more detail. As in FIG. 1, the model predictive controller 200 may receive at least one signal 240 from a heat transfer device (not shown). The signal 240 may represent an actual measurement of a system variable, for example a temperature measurement, a flow measurement, a pressure measurement, and/or a liquid level measurement. These system measurements may represent an actual resource usage amount at one or more specific points in time. Actual resource usage amounts may include measurements of at least one of a temperature, a volumetric amount of a fluid, a volumetric rate of a fluid, an energy usage rate, a power usage, or combinations thereof. These actual resource usage amounts may then be saved and used by a future resource prediction module 210 of the model predictive controller 200 to predict future resource usage amounts.

Figure 3:
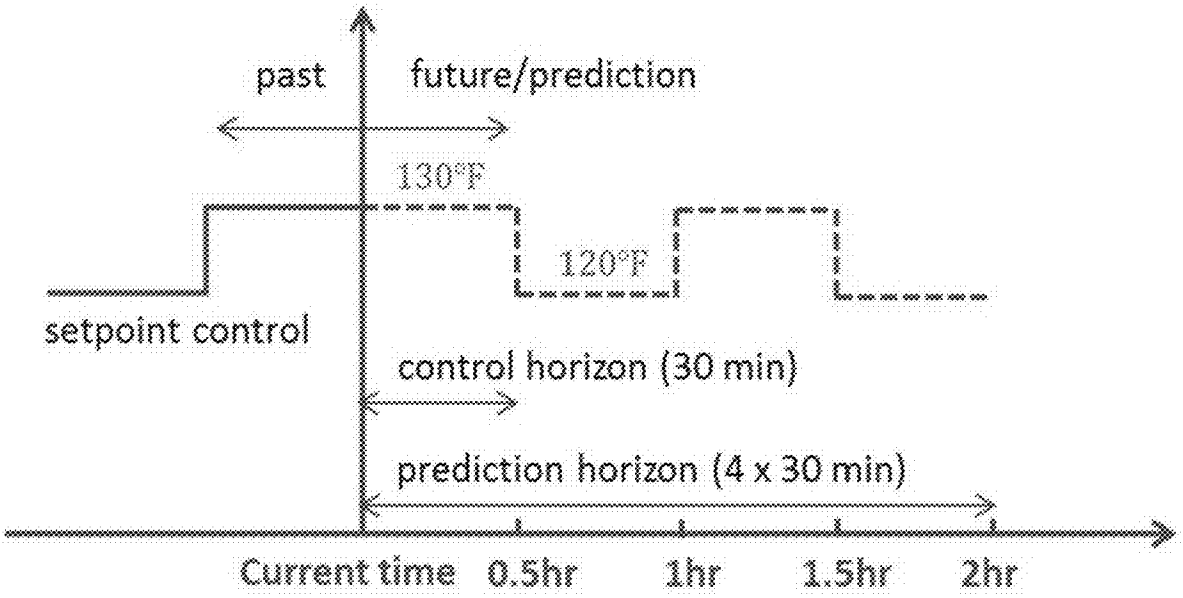
FIG. 3 illustrates some features of an embodiment of a future resource prediction module.

Referring to FIG. 3, a future resource prediction module (not shown) may divide a time interval (e.g. 1 day) into a number of bins (e.g. 48) such that each bin is about equal to 1 fraction of the first time period (e.g. 30 minutes). The average resource usage values for each time interval (e.g. 1 day) may be calculated and stored for an integer value of the time period (e.g. N=14, totaling 14 days) resulting in a time window. The time window (e.g. a 14-day window) may be recalculated and slide as time progresses and may be updated at the end of each time interval, such that the future resource prediction module may be able to capture new patterns in resource consumption and make more accurate future resource predictions.

In some embodiments of the current invention, a future resource prediction module may maintain a database constructed from various historical resource usage data, such that the predictive model controller utilizes the historical usage data to predict future resource usage requirements. Historical resource usage data may be stored, for example, using a computer equipped with a central processing unit (CPU) and a storage medium. In some embodiments, only a defined amount of historical usage data may be stored. For example, when data exceed a predetermined age limit, those data may be automatically deleted or over-written. In some embodiments, the amount of data stored may range from 1 day to 365 days of historical resource usage data. In other embodiments, the amount of data stored may range from 1 day to 30 days. In other examples, the amount of data stored may be essentially limitless, defined only by the amount of storage space.

A future resource prediction module may utilize the historical resource usage data in a number of different ways to produce future resource predictions. For example, a future resource prediction module may average the historical resource usage data for defined time intervals. Averaging methods that may be utilized in some of the embodiments of a model predictive controller described herein include the arithmetic mean, geometric mean, harmonic mean, quadratic mean, cubic mean, weighted mean, truncated mean, interquartile mean, Winsorized mean, or any other suitable method for calculating an average value for historical resource usage data. Alternatively or in addition to, a future resource prediction module may use maximum and/or minimum resource usage values for a given time interval to provide predictions for future resource usage requirements.

Referring again to FIG. 2, future resource prediction(s) 250 may then be communicated by the future resource prediction module 210 to a future energy calculation module 220. The purpose of the future energy calculation module 220 is to predict future energy requirements needed to meet the predicted future resource prediction. The future energy calculation module 220 also receives set-point estimates 265 from a third module, a control variable set-point optimizer module 230. The future energy calculation module 220 uses at least the future resource prediction 250 and the set-point estimate 265 to calculate a future energy and/or power requirement needed to meet the future resource prediction 250. In some embodiments, the future energy calculation module 220 may include a mass and energy balance defined for example, by the continuity equations. Alternatively, the future energy calculation module 220 may solve a mass and energy balance utilizing a state space model.

Figure 4:
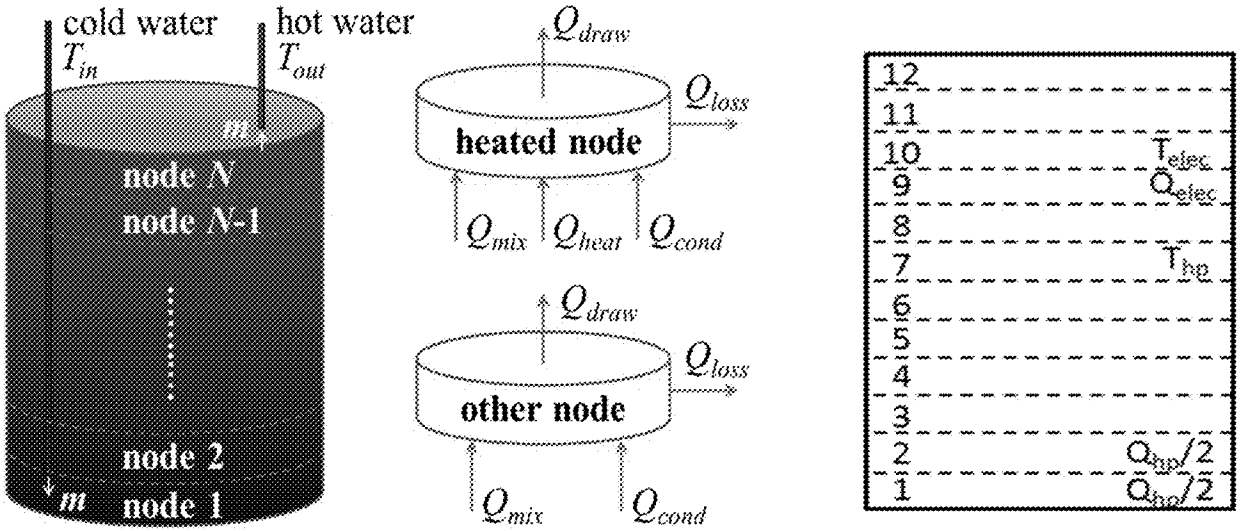
FIG. 4 shows some features of an embodiment of a future energy calculation module.

In some embodiments of the present invention, the future energy calculation module 220 may incorporate a dynamic 1-D model to complete a future energy estimate 260. FIG. 4 illustrates some of the elements of this embodiment, specifically for heat transfer to and/or from a stored liquid. This example model is constructed from a series of nodes where higher nodes have a temperature greater or equal than the temperatures of lower nodes to account for stratification due to buoyancy. For the alternative case, where the lower nodes have higher temperatures than the upper nodes, mixing may occur between nodes when the temperature of the upper node is lower than that of the lower node, which results in a more complicated mathematical construction. However, both examples are within the scope of the present invention.

An example of an energy balance is shown in the equation below, which describes a 1-D model based on an instantaneous energy balance for each node:

$$C_i \frac{dT_i}{dt} = \dot{Q}_{heat,i} - \dot{Q}_{loss,i} - \dot{Q}_{draw,i} + \dot{Q}_{cond,i} + \dot{Q}_{mix,i} \tag{1}$$

where $C_i$ is defined as the product of the mass of liquid in node i and heat capacity of liquid $C_p$, $T_i$ is the temperature of node i, and $\dot{Q}$ denotes the rate of change in thermal energy. This equation also accounts for auxiliary heating $Q_{heat}$, standby loss $Q_{loss}$, draw $Q_{draw}$, conduction $Q_{cond}$, and mixing in a storage volume $Q_{mix}$. Equation 1 may be applied to, for example, storage water heaters.

A future energy estimate may also be calculated using a state space model. To simulate the non-iterative part of Equation 1, a continuous-time state space model may be developed by neglecting conduction and mixing terms:

$$\dot{x}(t)=A_c(t)x(t)+B_c(t)u(t) \tag{2}$$

$$y(t)=C_c x(t) \tag{3}$$

where state $x=[T_1, T_2, \ldots, T_{12}]^T$, control $u=[\upsilon_{hp}, \upsilon_{elec}, T_{env}, T_{in}]$, $T_i$ may be a temperature of node i, $T_{env}$ may be an ambient temperature, $T_{in}$ may be an inlet liquid temperature, and $\upsilon_{hp}$ and $\upsilon_{elec}$ may be the binary control signals of a first and second heating element, respectively. A state space model may be applied to, for example, storage water heaters. The definition of $A_c$, $B_c$ and $C_c$ matrices for a water heater example can be found in *Advanced Control of Residential Water Heaters for Energy Efficiency*; available at the National Renewable Energy Laboratory, www.nrel.gov, 2015, which is incorporated herein by reference in its entirety.

This example of a state space model is a linear time-variant system because matrices $A_c$ and $B_c$ vary with time if flow rate changes. To incorporate flow rate and temperature information that is recorded in discrete time, a discrete-time state space model may be more suitable. Therefore, Equations (2) and (3) may be discretized, assuming zero-order hold for the input u, to $$x[k+1]=A_d[k]x[k]+B_d[k]u[k] \tag{4}$$

$$y[k]=C_d x[k] \tag{5}$$

where $A_d$ and $B_d$ may be computed by utilizing the following property with the sample time $\tau$ $$A_d=e^{A_c\tau}, B_d=e^{B_c\tau}, \text{ and } C_d=C_c \tag{6}$$

In the above equations, the subscript "c" denotes continuous time, while the subscript "d" denotes discrete time. Since the system is time-variant, $A_d$ and $B_d$ need to be updated at every time step. $C_d$ is the same as $C_c$. The choice of T may be a trade-off between model accuracy and implementation speed.

Referring again to FIG. 2, the future energy calculation module 220 may then communicate a future energy estimate 260 resulting from a mass and energy balance to a control set-point optimizer module 230. The control set-point optimizer 230 may then calculate a new set-point estimate 265 by solving and optimizing an objective function that is a function of at least the set-point estimate 265 and the future energy estimate 260. For example, an objective function may be optimized when a set-point estimate 265 is found that minimizes the future energy estimate 260 needed to meet the future resource prediction 250 provided by the future resource prediction module 210. In some embodiments of the present invention, an objective function may be optimized by minimizing a numeric value calculated by the objective function. In other embodiments of the present invention, an objective function may be optimized by maximizing a numeric value calculated by the objective function.

A mathematical example of an objective function used in some of the embodiments of the present invention is described by the equation below:

$$R^{opt}=\text{argmin}_R \sum_{j=1}^{H}\{\alpha c_{rate}(j)[P_1(R(i)+P_2(R(i))]+\beta Sag(j)\} \tag{7}$$

where $R^{opt}$ may be an optimized set-point estimate 265, H may be a prediction horizon, $\alpha$ may be a weighting function for the future energy estimate 260, $c_{rate}$ may be an electricity rate, $P_1$ may be a power consumed by a first heating element, $P_2$ may be a power consumed by a second heating element, R may represent values for the current set-point estimates being evaluated, $\beta$ may be a weighting function for an additional indicator (Sag representing some other metric besides energy) to be optimized. In this example of an objective function, Equation 2 aims to find optimal set-points $R^{opt}$ that minimize a weighted sum of a future energy consumption and the second indicator (Sag) over a prediction horizon H.

A prediction horizon refers to one method that may be employed by the future resource prediction module 210 of the model predictive controller 200. FIG. 3 illustrates one example of a prediction horizon, specifically a receding horizon concept, which may be incorporated into a model predictive controller. In this example, a prediction time step may be defined (e.g. half an hour) and a prediction horizon may be defined as four prediction time steps into the future (e.g. two hours). At a current time, a set-point profile that optimizes the objective function over the next prediction time step (e.g. two hours) is iteratively determined, and the first step of the set-point profile is implemented during the first prediction time step (e.g. the first immediate 30 minutes). The entire process may then be repeated at the end of the first time step (e.g. corresponding to the first 30 minutes), at which point in time, a new set-point profile may be generated (hence the term "receding" horizon).

Referring again to FIG. 2, in some embodiments of the present invention, the three modules of the model predictive controller 200 (a future resource prediction module 210, a future energy calculation module 220, and a control variable set-point optimizer module 230) function together in an iterative fashion, continuously and/or semi-continuously in time. For example, a future resource prediction module 210 may continuously obtain actual resource usage measurements (in the form of a signal 240) from the heat transfer system (not shown) and continuously utilize the actual resource usage measurements to maintain actual usage data (e.g. a database) to enable predicting future resource usage needs.

The invention now being generally described will be more readily understood by reference to the following examples, which are included merely for the purposes of illustration of certain aspects of the embodiments of the present invention. The examples are not intended to limit the invention, as one of skill in the art would recognize from the above teachings and the following examples that other techniques and methods can satisfy the claims and can be employed without departing from the scope of the claimed invention. Although only a few exemplary embodiments of this invention have been described in detail above, those skilled in the art will readily appreciate that many modifications are possible in the exemplary embodiments without materially departing from the novel teachings and advantages of this invention.

EXAMPLE 1

Heat pump water heaters (HPWH) in the United States typically feature both a heat pump and at least one electric resistance element for heating. The heat pump is much more efficient than the element but cannot heat the water as quickly. The combination of these two heat sources makes HPWH a candidate for implementing advanced control methods to achieve additional energy savings. This example describes an embodiment of the present invention where predictive control methods provide optimal set-point profiles for both heating elements based on the patterns discovered from users' hot water usage data. A simulation study presented herein indicate these predictive control methods are able to achieve significant energy savings without impacting users' thermal comfort.

Unlike traditional control methods, this example provides a prediction module, which estimates the hot water draw volume in the near future based on historical draw profiles. Flow rate and time of use information are recorded and used to predict the future draw profiles. Day of week information is also used since the draw patterns during weekdays and weekends may be drastically different. Prediction of future draw profiles is performed on the data of the past twenty days and is updated daily. A new cost function is defined to consider both energy savings and thermal comfort in the optimization procedure. An extensive search method is used with a simplified physics-based model to find the optimal set-point profile that minimizes the cost function over the prediction horizon. A simulation study presented herein (below) indicates that this example of a predictive model method is able to achieve up to 20% energy savings while still providing acceptable comfort compared to baseline methods. The method is also able to incorporate a time-of-use pricing structure to create additional cost savings for users and shift the load from on-peak to off-peak for the electricity grid.

Equation 1 above was applied to a storage water heater. Specifically, Equation 1 was applied to a heat pump water heater (HPWH). As shown in FIG. 4, the entire tank was uniformly divided into 12 nodes. The immersed heat pump was located at the bottom of the tank in nodes 1 and 2. The temperature sensor for the heat pump was located in node 7. The element was located in node 9, providing 4.5 kW of heat capacity in case the heat pump was unable to meet the usage requirement. The temperature sensor for the heating element was located in node 10. Table I summarizes the parameters used in this HPWH model.

TABLE 1

Parameters of a HPWH model

| Items | Values |
|---|---|
| Nominal volume | 66 gallons (0.238 $m^3$) |
| Heat pump differential | 18° F. (10° C.) |
| Electric element differential | 15° F. (8.3° C.) |
| Power of electric element | 4.5 kW |
| Standby power | 2.39 W |

As described above, a state space model was used to solve this system's energy balance. Both consumed electric energy and delivered energy of the HPWH model were calculated and compared with the data collected from an actual laboratory test of an equivalent actual HPWH. As shown in Table 2, differences for both terms are within 4%, indicating the model is a reasonable approximation of the actual HPWH.

TABLE 2

HPWH model validation data

| | Consumed Energy | Delivered Energy |
|---|---|---|
| Matlab Model | 7.39 kWh | 16.84 kWh |
| Laboratory Data | 7.66 kWh | 16.25 kWh |
| Difference | −3.81% | 3.65% |

Figure 5:
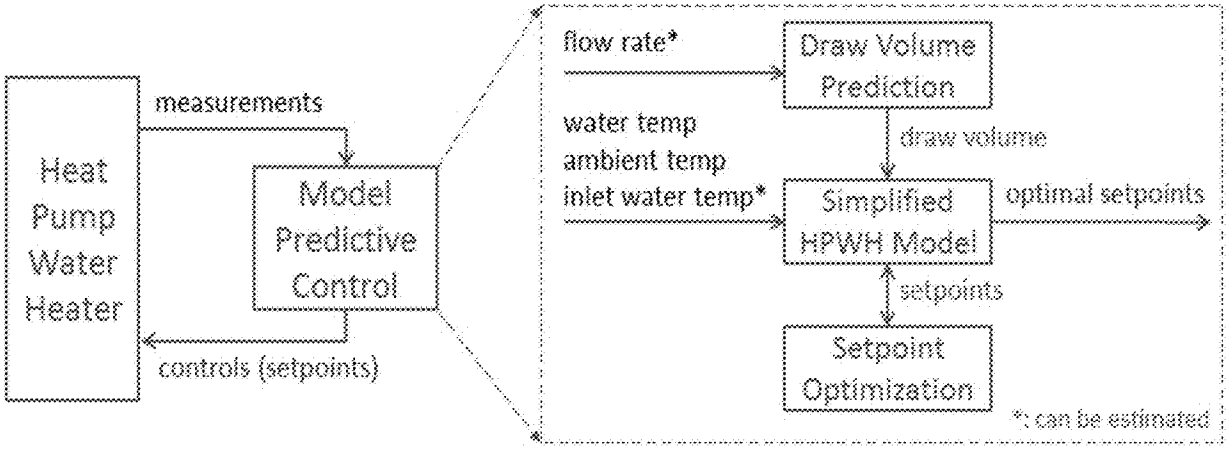
FIG. 5 illustrates an embodiment of the present invention, a model predictive controller configured to control a heat pump water heater.

Based on these results, a novel framework for a model predictive controller (MPC) for a HPWH was developed. As shown in FIG. 5, the MPC takes measurements from the HPWH, calculates the optimal control strategies based on measurements, and sends the optimal set-point profiles back to the HPWH as the control signal. In this MPC framework, the set-points are controlled rather than directly controlling the heat source. Among other things, this strategy may reduce instrumentation costs and improve safety. The right half of FIG. 5 shows the detailed structure of the controller, consisting of the three modules described above: draw volume prediction (resource prediction module), a simplified HPWH model (energy calculation module), and set-point optimization (control variable set-point optimizer module).

Unlike the building air conditioning control problem, disturbances such as hot water draws are the dominating factor affecting the operation of water heaters. To effectively control the water heater, it is desirable to proactively respond to the upcoming draw events, rather than reactively turn on the heat sources when the tank temperature is too low. For this reason, it is desirable to estimate the hot water draw volume based on past hot water consumption and incorporate the estimation into the MPC framework. Flow rate is the input of the draw volume prediction model, and can be measured by a flow meter or estimated by its low-cost alternatives.

A model is needed to predict the tank water temperature given the estimated draw volume and set-point temperature. Linear time-invariant models are not appropriate for fully describing the HPWH performance, as they cannot model the effects of different flow rates and the mixing effect inside the tank. Although the 12-node model described in above captures the tank dynamics well, it may be too complex to serve as the prediction model in the field. As a trade-off between computational load and model accuracy, a simplified 2-node model as the prediction model was used, which is described in more detail below.

In this example, the goal of the MPC controller is to generate optimal set-points for a heat pump and a resistive heating element. A simple but effective approach used in this example to find the optimal set-points was an exhaustive search approach. The costs associated with all possible combination of set-points were calculated, and the set-points that generate minimum cost were selected as the optimal set-points. The computation load of this method depended on the length of the prediction horizon and the complexity of the prediction model. The objective function used in set-point optimization for a MPC of a HPWH was defined as follows (based on Equation 7 above but defined for the specific heating elements of a HPWH):

$$R^{opt} = \underset{i}{\operatorname{argmin}} \sum_{j=1}^{H} \{\alpha c_{rate}(j)[P_{hp}(R(i)) + P_{elec}(R(i))] + \beta Sag(j)\} \tag{8}$$

where $R^{opt}$ is the optimal setpoint, H is the prediction horizon (in terms of number of steps), $\alpha$ is the weighting function for consumed energy, $c_{rate}$ is the electricity rate (a flat rate was used here, but time of use rates could also be accommodated), $P_{hp}$ is the power consumed by the heat pump, $P_{elec}$ is the power consumed by the element, R is the current setpoints being evaluated, $\beta$ is the weighting function for thermal comfort, and Sag is an indicator of thermal comfort.

Equation 8 was optimized to find the optimal set-points $R^{opt}$ that minimized the weighted sum of energy consumption and thermal comfort over the prediction horizon H. When using a flat rate pricing structure, the model predictive controller minimized the consumed energy and also minimized the energy cost. If a time of use pricing structure is used, the proposed framework could be used with demand response analysis, thereby saving energy cost for end-users and shifting load to off-peak periods.

FIG. 3 illustrates the receding horizon concept, one embodiment of the proposed MPC framework. In this example, the prediction time step is half an hour and the prediction horizon is four steps, corresponding to two hours into the future. At the current time, the set-point profile that minimized the cost over the next two hours was calculated by optimizing the objective function (Equation 8), and the first step of the set-point profile was implemented for the next 30 minutes. The entire process was repeated at the end of the first step, and a new set-point profile was generated. This procedure would be repeated in an iterative fashion as long as the HPWH was in operation.

Figure 6:
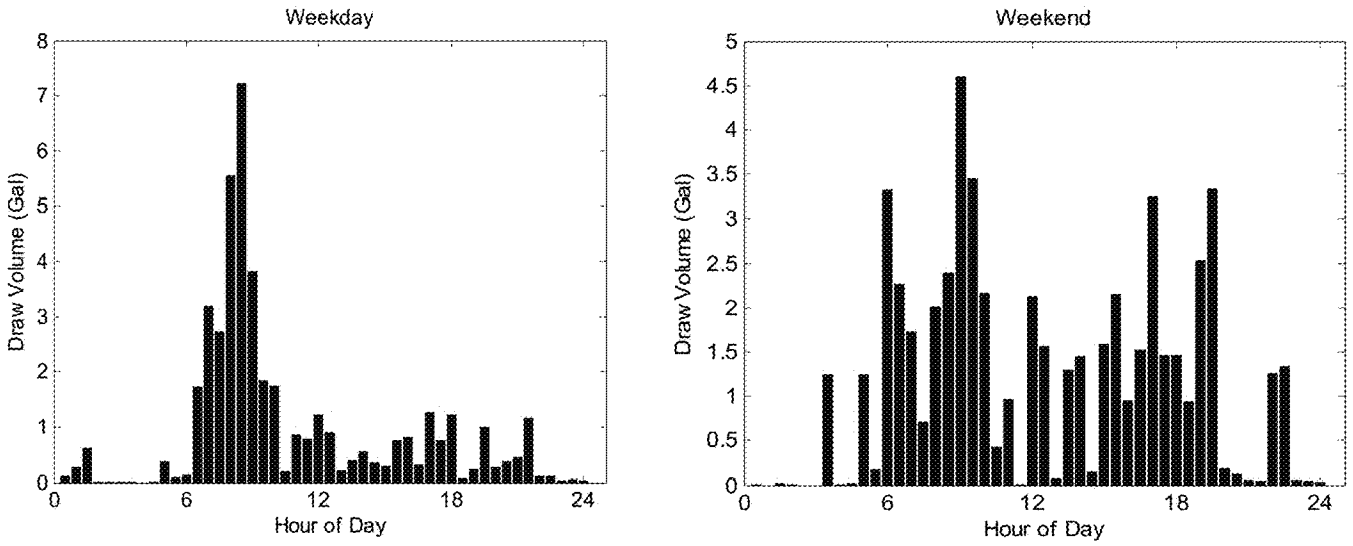
FIG. 6 shows data collected by a resource prediction module.

Accurate predictions of future draw events are desirable for a MPC to efficiently control a HPWH. This example utilizes a new prediction algorithm that was designed to predict the draw volume for each prediction time step. Referring to FIG. 6, the entire day was uniformly divided into 48 bins, each with a width of 30 minutes. The average daily draw volume of the past 10 days in each bin was calculated and served as the predicted amount of draw volume for each prediction time step. The 14-day window was sliding and updated at the end of each day, so the prediction algorithm was able to capture new patterns in hot water consumption. Weekday and weekend data were considered separately, as the hot water consumption patterns are drastically different during weekdays and weekends. FIG. 6 shows, among other things, the differences between weekday and weekend draw patterns. For the data used in this analysis, draw patterns during weekdays have a major peak in the morning corresponding to morning showers and other activities, whereas draw patterns during weekends are more flattened and minor peaks exist throughout the entire day.

This example also utilizes a prediction model to estimate the future status of the physical system and identify the control strategy that optimizes the objective function by minimizing the cost function. The search process could be computationally expensive, especially when the prediction model is complex or the search space is large. As shown in FIG. 4, a 12-node HPWH model can be a good approximation of the actual system. However, it may not be a good prediction model for a HPWH MPC for at least the following two reasons: (1) its computational cost may be too high due to the number of nodes and required iterations; and (2) temperature measurements may be needed for each node to update the model status, which makes the instrumentation more expensive and may reduce the reliability of the entire system. Therefore, a simplified model may help to alleviate the aforementioned problems.

Figure 7:
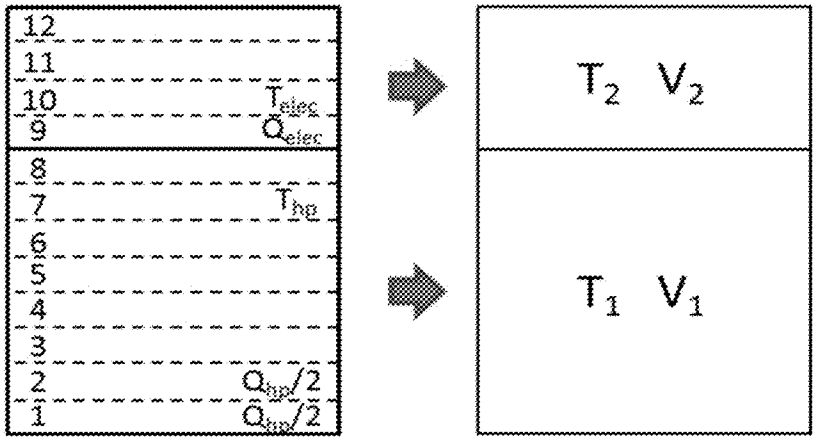
FIG. 7 shows an embodiment of the present invention, a simplified future energy calculation module.

FIG. 7 presents the layout of a 2-node HPWH prediction model, which was formulated by combining the nodes in the original 12-node HPWH model. To achieve this simplified model, nodes 1-8 of the model illustrated in FIG. 4 were combined to form a new node of volume $V_1$, and nodes 9-12 of the model illustrated in FIG. 4 were combined to form a new node of volume $V_2$. This was done partly due to the location of the existing temperature sensors in the actual laboratory test HPWH's tank. The temperature sensors for the heat pump and the element were located in node 7 and node 10, respectively, of the more complex model. By combing the first 8 nodes together and the remaining 4 nodes together, the temperature measurements taken from the sensors were directly used to update the states of the prediction model, thereby removing the need for additional temperature sensors.

The 2-node model was compared with the 12-node model using a 30-day long draw profile generated by the Domestic Hot Water Event Schedule Generator (DHWESG). The validation results are summarized below in Table 3, where the total energy use, heat pump energy use, electric element energy use, and delivered energy are compared for the 12-node model and 2-node model. Overall, the prediction outcome of both models is close: the energy use difference is 2.40% and the delivered energy difference is −5.21%. The 2-node model overestimated the heat pump energy use by more than 8%, because $T_1$ in the new model was usually lower than $T_{hp}$ in the original model due to stratification and thus the heat pump turned on more often. Similarly, $T_2$ was in general higher than $T_{elec}$, so the element of the 2-node model consumed less energy than that of the 12-node model.

TABLE 3

Model Validation using DHWESG Profiles (30 days)

| Model Type | 12-node | 2-node | Difference |
|---|---|---|---|
| Total Energy Use (kWh) | 134.80 | 138.04 | 2.40% |
| Heat Pump (kWh) | 95.12 | 104.11 | 8.63% |
| Electric Element (kWh) | 38.25 | 36.38 | −4.89% |
| Delivered Energy (kWh) | 327.61 | 310.53 | −5.21% |

An extensive search algorithm was used to find the optimal control set-points for the HPWH. Two candidate control set-points were defined for both the heat pump and element. In this example, the heat pump may switch between 120° F. and 130° F., and the resistive heating element may switch between 120° F. and 115° F. These set-points were chosen to minimize electric element usage and maximize heat pump usage. More set-points may be included in the procedure. There were in total $4^{2\times2}=256$ control set-point profiles to be explored and the associated cost to be computed. Additional constraints may be applied to reduce the number of candidate control set-point profiles and increase the speed of the optimization process.

This example presents simulation results utilizing the MPC for a HPWH presented in this example, using field test data collected from two studies: a low use (35 gal/day) home in Boulder, Colo. and a high use (92 gal/day) home in Sacramento, Calif. Long-term monitoring equipment was installed to collect water usage data from these homes for over a year. Two performance metrics, namely, energy savings and temperature sag, were used to evaluate the effectiveness of the proposed MPC algorithm. Temperature sag is defined as the additional amount of energy needed to heat the water back up to a level that would be acceptable for users in cases where the outlet temperature drops below a comfortable level (assumed here to be 110° F.). Tracking this metric is desirable to ensure that the different control algorithms do not provide energy savings at the expense of providing inadequate hot water.

FIG. 8 summarizes the performance of the MPC method for one day in the high use home. On this day, past draw patterns predicted large draws occurring in the evening. Based on this prediction, the heat pump set-point was raised to 140° F. for two periods. While there was only a small draw after the first period where the heat pump set-point was raised, there was a large draw after the second period. Preheating the tank ahead of this draw allowed the heat pump to meet this load instead of using the electric resistance element. This illustrates that while this exemplary model did not perfectly predict large draw events due to the day-to-day variations in hot water use, it was able to identify when hot water events were likely to occur and respond appropriately.

For comparative evaluation of the advanced controls, two baseline simulations were also conducted using different set-points for each home. The first baseline used 120° F. as the set-point for both the heat pump and the resistive heating element. The second baseline used whatever the highest temperature used for the heat pump was (130° F. for the low use home and 140° F. for the high use home) and 120° F. as the set-point for the resistive heating element. A higher temperature was used in the high use home to ensure that the HPWH was able to provide adequate hot water.

Table 4 shows the results for the MPC cases and baseline cases for both low and high end-uses. Total energy consumption, as well as energy consumed by both heat pump and element, is presented, along with temperature sag. Table 4 shows that the MPC consumed less total energy than either baseline in both cases. While the MPC case can provide better thermal comfort than baseline 1, baseline 2 provided the best thermal comfort of the cases considered here at the expense of much higher energy consumption.

Table 5 summarizes the annual savings achieved by MPC in terms of both energy and cost. Compared to baseline 1, the MPC yielded up to 40 kWh annual energy savings. Life-cycle cost savings should be able to recover the instrumentation cost needed to implement the MPC technique in a HPWH relative to this baseline while still achieving greater thermal comfort. Compared to baseline 2, the MPC achieved about 170-190 kWh of annual energy savings and more than $20 annual cost savings, which would provide net life cycle cost savings for a homeowner.

TABLE 4

Results of a year-long simulation for the two draw profiles

| | | Setpoint (° F.) | | Energy Consumption (kWh) | | | Tem- |
|---|---|---|---|---|---|---|---|
| Case | Method | Heat Pump | Elec-tric | Total | Heat Pump | Elec-tric | perature Sag (kJ) |
| Low Use | Baseline 1 | 120 | 120 | 736.7 | 599.9 | 117.6 | 121.8 |
| | Baseline 2 | 130 | 120 | 867.8 | 821.9 | 27.2 | 2.9 |
| | MPC | 130/120 | 120/115 | 697.3 | 650.9 | 27.4 | 46.0 |
| High Use | Baseline 1 | 120 | 120 | 1754 | 1192 | 541.1 | 1798 |
| | Baseline 2 | 140 | 120 | 1906 | 1740 | 145.0 | 332.2 |
| | MPC | 140/120 | 120/115 | 1715 | 1478 | 215.9 | 1548 |

TABLE 5

Comparison of energy and cost savings between an MPC and baseline methods

| Case | Metric | MPC vs. Baseline 1 | MPC vs. Baseline 2 |
|---|---|---|---|
| Low Use | Annual Energy | 39.37 kWh (5.3%) | 170.48 kWh (19.6%) |
| | Annual Cost Savings | $4.72 | $20.46 |
| High Use | Annual Energy | 38.5 kWh (2.2%) | 190.7 kWh (10.0%) |
| | Annual Cost Savings | $4.62 | $22.89 |

EXAMPLE 2

This example summarizes experiments focused on comparing simulation results to actual laboratory data of a model predictive controller's performance, as well as the performance of MPC for HPWH embodiments of the present invention as described herein to standard methods for controlling HPWH.

A first set of experiments compared actual lab data of an MPC controlled HPWH to simulation data of a MPC controlled HPWH. The laboratory tests were completed using a GeoSpring HPWH from GE. This unit contained a heat pump and two electric heating elements. One element was located near the top of the tank and the other was located near the bottom. Nominal design specifications for a GeoSpring HPWH are tabulated below.

TABLE 6

GeoSpring HPWH
Table 1: HPWH nominal parameters

| | |
|---|---|
| Volume | 50 gal |
| Lower Element Power | 4.5 kW |
| Upper Element Power | 4.5 kW |
| Compressor Power | 700 W |

The GeoSpring water heater was outfitted with various sensors to monitor performance (more on this below). To implement embodiments of the present invention's model predictive controller, the manufacturer's control board was removed and replaced with hardware that allowed implementation and use of some embodiments of the present invention, for example, as summarized in FIGS. 1 and 2.

The following parameters were monitored during actual experimental testing of the laboratory set-up: ambient dry bulb temperature, ambient relative humidity, internal tank temperature (measured at 6 points within the tank), inlet and outlet water temperatures, outlet dry bulb temperature and relative humidity, lower and upper element temperatures, power consumed by the HPWH, and the water flow rate out of the water heater. Wet bulb temperatures were calculated at the fan outlet and for the ambient environment. Inlet and outlet water temperatures were measured using thermocouples placed inside the inlet and outlet lines. The internal tank temperatures were measured by inserting a thermocouple tree through into the tank itself. This provided 6 nodes within the storage tank volume, as shown in FIG. 9. Each node contained an equal volume of water. The lower and upper element temperatures, TLE and TUE, were monitored by attaching thermocouples to the side of the tank, under the insulation, and near the respective heating elements. These two temperatures were selected as control points for controlling the different heating mechanisms. The power of the water heater did not include the fan because it was powered externally. In this example, although all these parameters were recorded, only the lower and upper element temperatures, outlet flow rate, ambient dry bulb temperature, and ambient wet bulb temperature were utilized by the MPC.

As mentioned, to implement some of the MPC control methods described herein, the manufacturer's control board provided with the HPWH was replaced with a custom board. The replacement board contained three relays that controlled power to the heat pump and the elements in the unit. The board also contained a small circuit which controlled the fans for the heat pump. This new board allowed any type of control scheme to be tested. The GeoSpring HPWH performance resulting from the disclosed MPC control strategy described herein was compared to the controls for an 80 gallon A.O. Smith Voltex. These controls were chosen because the A.O. Smith controls were considered to be more indicative of standard HPWH controls.

Each test began by preheating of the actual HPWH such that the preheating conditions matched the simulation conditions. Specifically, preheating began with activating the heat pump until node 6 of the tank reached a temperature of about 40° C. NExt, the lower element was turned on until node 5 reached a temperature of about 44° C. Finally, the upper element was turned on until node 2 reached a temperature of about 52° C. Once these temperatures were reached, a modified draw profile was run. Data was recorded at 5 Hz resolution. After the draw profile was finished, all the data collected was averaged to minute resolution. This procedure was completed both for the MPC control strategies described herein and also for the baseline controls with temperature set-points set equal to and fixed at about 48.89° C. Finally, the identical conditions were simulated for both the proposed MPC control strategies and the baseline controls, for comparison.

Three metrics were compared: total energy consumed by the water heater, delivered energy, and droop energy. The total energy was the total energy used by the HPWH throughout the test period. The delivered energy was defined as the energy difference between the inlet and outlet water temperatures, specified by the following formula:

$$E_{del}=m*c_p*\Delta T$$

where m was the mass water drawn, $c_p$ was the specific heat of water, and ΔT was the temperature difference between the inlet and outlet.

As mentioned before, the Sag energy is a measure of comfort levels and was defined as $$E_{sag}=(T_{comfort}-T_{out})*m*C_p \text{ if } T_{out}<T_{comfort}$$

$$E_{sag}=0 \text{ otherwise}$$

where $T_{comfort}$ was 43.33° C. and $T_{out}$ was the outlet water temperature.

Simulation results of HPWH utilizing the disclosed MPC strategies described herein were compared to actual results using a similarly configured actual HPWH configured with an MPC. The results are displayed in Table 7 and in FIG. 10. Both simulation and measured data show that their corresponding model predictive controllers predicted large draws in the afternoon. This is evident by the raised set-point of the heat pump prior to the event. Both the simulated controller and the actual laboratory controller prevented the resistive heating elements from turning on because of preheating provided by the heat pump heating element. The differences between the simulated HPWH performance and the experimental HPWH performance was ~3.1% for consumed energy, ~3.8% for delivered energy, and ~7.12% for Sag energy.

TABLE 7

Measured versus Simulated HPWH Data

| | Simulated | Measured | Difference |
|---|---|---|---|
| Total Energy (kWh) | 2.05 | 2.11 | 3.10% |
| Delivered Energy (kWh) | 6.07 | 6.30 | 3.79% |
| Sag Energy (kJ) | 32.3 | 34.6 | 7.12% |

A discrepancy was observed between the measured control temperature and the modeled control temperature when the heat pump first turned on. The measured control temperature was higher than the modeled temperature. This difference ranged from about 1° C. to almost 5° C., as shown in FIG. 11. In the laboratory water heater, the condenser coils for the heat pump were wrapped around the tank and were close to the external thermocouples. It is speculated that when the heat pump first turned on, it caused the outside of the tank to heat up quicker than the internal tank temperatures. This may be the cause for the increased temperatures measured in the lab. Despite this discrepancy, the simulation results closely approximated the corresponding laboratory results.

The performance of this embodiment of the present invention, a MPC configured to control a HPWH, was also compared to a baseline case where the static set-point of about 48.89° C. was selected. For the case of MPC control of the HPWH, the energy consumed by the heat pump increased by 45.4%, but use of the resistive heating elements was completely eliminated. This resulted in a total reduction in energy use of about 33.7%. Thermal comfort was also improved as evidenced by a decrease in Sag energy of about 62.0%. FIG. 12 illustrates that raising the set-point ahead of the draw event heated the tank so that it was not necessary to utilize the resistive heating elements. These results are summarized in Table 8.

TABLE 8

MPC Control of a HPWH versus Fixed Set-Point Control

| | MPC | Baseline | Difference |
|---|---|---|---|
| Total Energy (kWh) | 2.05 | 3.09 | −33.67% |
| Heat Pump Energy (kWh) | 2.05 | 1.41 | 45.37% |
| Electric Element Energy (kWh) | 0.00 | 1.65 | −100.00% |
| Delivered energy (kWh) | 6.07 | 5.90 | 2.88% |
| Sag Energy (kWh) | 32.29 | 84.52 | −61.80% |

What is claimed is:

1. A method for controlling a temperature of a fluid, the method comprising:

an minimizing energy required to heat the fluid, wherein the method includes a model predictive controller configured to achieve the minimizing using a objective function defined by $R^{opt} \propto C_{rate}[P_1(R(i))+P_2(R(i))]$, wherein:

$R^{opt}$ is an optimized fluid temperature set-point, $P_1$ is the first power consumed by a first heating element to achieve a fluid temperature set-point (R(i)), $P_2$ is the second power consumed by a second heating element to achieve the fluid temperature set-point (R(i)), and $C_{rate}$ is an electricity rate;

changing the fluid temperature set-point; and heating the fluid utilizing the first heating element and the second heating element to the optimized fluid temperature set-point;

solving the objective function for the optimized fluid temperature set-point with the changed fluid temperature set-point;

repeating the changing and the solving until the minimizing is achieved;

adjusting at least one of the first power consumed by a first heating element or the second power consumed by a second heating element so that the fluid attains the optimized fluid temperature set-point; and heating the fluid utilizing the first heating element and the second heating element to the optimized fluid temperature set-point.

2. The method of claim 1, wherein the objective function is also a function of a future fluid usage prediction, and the future fluid prediction is at least partially determined by historical fluid usage data.

3. The method of claim 2, wherein the historical fluid usage data are determined by defining a first time period (T);

defining a second time period (t) by dividing T by an integer value (N) such that T is divided into N equal and consecutive time intervals ($t_n$), wherein T restarts and repeats upon completion of the last $t_n$; and collecting consecutive measurements of actual fluid usage data ($F_n$) for each consecutive $t_n$ as the historical usage data.

4. The method of claim 3, further comprising storing on a data storage medium no more than N sets of consecutive measurements.

5. The method of claim 4, wherein the historical fluid usage data comprises a measurement of least one of a fluid flow or a fluid temperature.

6. The method of claim 1, wherein the first heating element and the second heating element comprise at least one of a resistive heating element or a heat pump.

7. The method of claim 1, wherein the fluid is a liquid.

8. The method of claim 7, wherein the liquid is water.

9. The method of claim 1, wherein the optimized fluid temperature set-point ranges from about 0° F. to about 500° F.

10. A method for controlling a temperature of water utilizing a resistive heating element and a heat pump, the method comprising:

minimizing the sum of the first power consumed by a heat pump and a second power consumed by a resistive heating element, wherein the minimizing is achieved using an objective function defined by $R^{opt} \propto C_{rate}[P_{hp}(R(i))+P_{elec}(R(i))]$, wherein:

$R^{opt}$ is an optimized water temperature set-point for the water, $P_1$ is the first power consumed by a heat pump to achieve a water temperature set-point (R(i)), $P_2$ is the second power consumed by a resistive heating element to achieve the water temperature set-point (R(i)), and $C_{rate}$ is an electricity rate;

changing the water temperature set-point;

solving the objective function for the optimized water temperature set-point with the changed water temperature set-point;

repeating the changing and the solving until the minimization is achieved; and adjusting at least one of the resistive heating element or the heat pump to heat the water to the optimized water temperature set-point.

11. The method of claim 10, wherein the objective function is also a function of a future water volume usage prediction, and the future water volume usage prediction is at least partially determined by historical water volume usage data.

12. The method of claim 11, wherein the historical water usage data are determined by defining a first time period;

defining a second time period by dividing the first time period by an integer (N);

defining a third time period by dividing the second time period by an integer (I) to create N*I consecutive time intervals, wherein each time interval is about equal to the third time period; and collecting consecutive measurements of actual water flow and water temperature data for each consecutive time interval as the historical usage data.

13. The method of claim 12, wherein the first time period equals about 14 days, the second time period equals about 1 day for an N of about 14, and the third time period is about 30 minutes for an I of about 48.

* * * * *